US009245725B2

(12) United States Patent
Ibrahim et al.

(10) Patent No.: US 9,245,725 B2
(45) Date of Patent: Jan. 26, 2016

(54) ION TRAP DEVICE

(71) Applicants: Yehia M. Ibrahim, Richland, WA (US); Richard D. Smith, Richland, WA (US)

(72) Inventors: Yehia M. Ibrahim, Richland, WA (US); Richard D. Smith, Richland, WA (US)

(73) Assignee: BATTELLE MEMORIAL INSTITUTE, Richland, WA (US)

( * ) Notice: Subject to any disclaimer, the term of this patent is extended or adjusted under 35 U.S.C. 154(b) by 0 days.

(21) Appl. No.: 14/179,008

(22) Filed: Feb. 12, 2014

(65) Prior Publication Data

US 2014/0264014 A1 Sep. 18, 2014

Related U.S. Application Data

(60) Provisional application No. 61/779,825, filed on Mar. 13, 2013.

(51) Int. Cl.
*H01J 49/34* (2006.01)
*H01J 49/06* (2006.01)

(52) U.S. Cl.
CPC ..... *H01J 49/065* (2013.01)

(58) Field of Classification Search
CPC ..... H01J 49/063; H01J 49/065; H01J 49/066; H01J 49/4205; H01J 49/421; H01J 49/4215; H01J 49/422; H01J 49/4225; H01J 49/423; H01J 49/4235; H01J 49/4245; H01J 49/425; H01J 49/4255
USPC ..... 250/281–283, 290, 293
See application file for complete search history.

(56) References Cited

U.S. PATENT DOCUMENTS

| | | | | |
|---|---|---|---|---|
| 7,888,635 | B2 | 2/2011 | Belov et al. | |
| 2004/0079880 | A1* | 4/2004 | Bateman et al. | 250/288 |
| 2005/0242280 | A1* | 11/2005 | Nikolaev | H01J 49/38 250/291 |
| 2006/0226357 | A1* | 10/2006 | Franzen et al. | 250/307 |
| 2009/0108194 | A1* | 4/2009 | Page | H01J 49/066 250/282 |
| 2009/0294662 | A1* | 12/2009 | Belov | H01J 49/4235 250/291 |
| 2011/0248160 | A1* | 10/2011 | Belov | H01J 49/0031 250/283 |
| 2012/0261570 | A1* | 10/2012 | Shvartsburg et al. | 250/287 |
| 2013/0099110 | A1* | 4/2013 | Hoyes | H01J 49/065 250/282 |

OTHER PUBLICATIONS

Lewin et al, "Ion Dispersion Near Parallel Wire Grids in Orthogonal Acceleration Time-of-Flight Mass Spectrometry: Predicting the Effect of the Approach Angle on Resolution", Rapid Communications in Mass Spectrometry, 2002, 16; 609-615.*

Revercomb, H. E., et al., Theory of Plasma Chromatography/Gaseous Electrophoresis—A Review, Analytical Chemistry, 47, 7, 1975, 970-983.

Tang, K., et al., High-Sensitivity Ion Mobility Spectrometry/Mass Spectrometry Using Electrodynamic Ion Funnel Interfaces, Analytical Chemistry, 77, 2005, 3330-3339.

(Continued)

*Primary Examiner* — Nicole Ippolito
*Assistant Examiner* — David E Smith
(74) *Attorney, Agent, or Firm* — A. J. Gokcek

(57) ABSTRACT

An ion trap device is disclosed. The device includes a series of electrodes that define an ion flow path. A radio frequency (RF) field is applied to the series of electrodes such that each electrode is phase shifted approximately 180 degrees from an adjacent electrode. A DC voltage is superimposed with the RF field to create a DC gradient to drive ions in the direction of the gradient. A second RF field or DC voltage is applied to selectively trap and release the ions from the device. Further, the device may be gridless and utilized at high pressure.

15 Claims, 9 Drawing Sheets

(56) References Cited

OTHER PUBLICATIONS

Howdle, M. D., et al., The effect of drift gas on the separation of active pharmaceutical ingredients and impurities by ion mobility-mass spectrometry, International Journal of Mass Spectrometry, 298, 2010, 72-77.
Ruotolo, B. T., et al., Peak capacity of ion mobility mass spectrometry: the utility of varying drift gas polarizability for the separation of tryptic peptides, Journal of Mass Spectrometry, 39, 2004, 361-367.
Asbury, G. R., et al., Using Different Drift Gases to Change Separation Factors (a) in Ion Mobility Spectrometry, Analytical Chemistry, 72, 2000, 580-584.
Matz, L. M., et al., Investigation of Drift Gas Selectivity in High Resolution Ion Mobility Spectrometry with Mass Spectrometry Detection, J. Am. Soc. Mass Spectrom., 13, 2002, 300-307.
Gillig, K. J., et al., Coupling High-Pressure MALDI with Ion Mobility/Orthogonal Time-of-Flight Mass Spectrometry, Analytical Chemistry, 72, 17, 2000, 3965-3971.
Wittmer, D., et al., Electrospray Ionization Ion Mobility Spectrometry, Analytical Chemistry, 66, 1994, 2348-2355.
Bradbury, N. E., et al., Absolute Values of the Electron Mobility in Hydrogen, Physical Review, 49, 1936, 388-393.
Zhou, L., et al., Mechanical ion gate for electrospray-ionization ion-mobility spectrometry, Anal Bioanal Chem, 388, 2007, 189-194.
Hoaglund, C. S., et al., An Ion Trap Interface for ESI-Ion Mobility Experiments, Analytical Chemistry, 69, 1997, 4156-4161.
Myung, S., et al., Development of High-Sensitivity Ion Trap Ion Mobility Spectrometry Time-of-Flight Techniques: A High-Throughput Nano-LC-IMS-TOF Separation of Peptides Arising from a Drosophila Protein Extract, Analytical Chemistry, 75, 2003, 5137-5145.
Creaser, C. S., et al., A Tandem Ion Trap/Ion Mobility Spectrometer, Analytical Chemistry, 72, 2000, 2724-2729.
Clowers, B. H., et al., Enhanced Ion Utilization Efficiency Using an Electrodynamic Ion Funnel Trap as an Injection Mechanism for Ion Mobility Spectrometry, Analytical Chemistry, 80, 2008, 612-623.
Ibrahim, Y., et al., Ion Funnel Trap Interface for Orthogonal Time-of-Flight Mass Spectrometry, Analytical Chemistry, 79, 2007, 7845-7852.
Applehans, A. D., et al., SIMION ion optics simulations at atmospheric pressure, International Journal of Mass Spectrometry, 244, 2006, 1-14.
Bush, M. F., et al., Ion Mobility Mass Spectrometry of Peptide Ions: Effects of Drift Gas and Calibration Strategies, Analytical Chemistry, 84, 2012, 7124-7130.

* cited by examiner

ION TRAP DEVICE

CROSS REFERENCE TO RELATED APPLICATIONS

The application claims priority to U.S. Provisional Application Ser. No. 61/779,825, filed Mar. 13, 2013, entitled "ION TRAPS AND PROCESS," hereby incorporated by reference for all of its teachings.

STATEMENT REGARDING FEDERALLY SPONSORED RESEARCH OR DEVELOPMENT

This invention was made with Government support under Contract DE-AC05-76RLO1830 awarded by the U.S. Department of Energy and Grant No. R21 GM103497 awarded by the National Institutes of Health. The Government has certain rights in the invention.

TECHNICAL FIELD

This invention relates to ion traps. More specifically, this invention relates to a gridless ion trap device that selectively traps and releases ions at high pressure by applying voltage to electrodes.

BACKGROUND OF THE INVENTION

Ion traps known in the art apply a DC potential to metal grids that create a repelling potential which prevent ions from moving into or out of the trap. However, these meshes do not store ions efficiently at high pressure. Accordingly new ion trap designs are needed that improve the storage and release of ions at high pressure. The present invention addresses these needs.

SUMMARY OF THE INVENTION

In accordance with one embodiment of the present invention, an ion trap device is disclosed. The device includes a series of electrodes that define an ion flow path. The device also includes a first radio frequency (RF) field applied to the series of electrodes such that a first RF waveform on each electrode is phase shifted approximately 180 degrees from the first RF waveform on an adjacent electrode. The device also includes a DC voltage superimposed with the RF field to create a DC gradient to drive ions in the direction of the gradient. The device further includes two or more wires that are substantially perpendicular to the ion path and to repel the ions. A second RF waveform applied to each wire is phase shifted approximately 180 degrees from the second RF waveform applied to an adjacent wire by application of a second RF field to the wires. In this embodiment, the device is gridless.

In one embodiment, the series of electrodes are a series of stacked ring electrodes that define the ion flow path.

In one embodiment, each of the electrodes in the series has an inner geometry perimeter that is equal to, greater than, or smaller than, an adjacent electrode in the series.

In one embodiment, the two or more wires are substantially parallel to one another.

In one embodiment, the two or more wires are substantially concentric to one another.

In one embodiment, the device has a pressure of about 50 mtorr or higher, and the DC gradient is between about 0 V/cm and about 100 V/cm.

In another embodiment of the present invention, an ion trap device is disclosed. The device includes a first set of electrodes and second set of electrodes. The first set of electrodes have an approximately 180 degrees out-of-phase RF field applied to adjacent electrodes, and DC gradient is superimposed with the RF field to drive ions in the direction of the gradient. The second set of electrodes is positioned adjacent to the first set of electrodes. A DC voltage is applied to the second set of electrodes to repel the ions.

In one embodiment, the spacing between the electrodes in the second set of electrodes is equal to the spacing between the electrodes in the first set of electrodes.

In one embodiment, the spacing between the electrodes in the second set of electrode is not equal to the spacing between the electrodes in the first set of electrodes.

In one embodiment, the spacing between the electrodes in the second of electrodes is similar.

In one embodiment, the spacing between the electrodes in the second set of electrodes is not similar.

In one embodiment, the electrodes of the first set are stacked-ring electrodes, and the electrodes of the second set are DC-only stacked-ring electrodes.

The voltage applied to the second set of electrodes is separated from a resistors chain the supplies the DC gradient to the first set of electrodes.

In another embodiment of the present invention, an ion trap device is disclosed. The device includes a series of stacked-ring electrodes that define an ion flow path. The device also includes an entrance grid and an exit grid. The ions travel on the z axis of the device. An angle formed by varying the inner diameters of the electrodes after the exit grid in the xz-plane or the yz-plane is equal to or greater than 90 degrees. A DC voltage is applied opposite to the direction of the ion flow path to the grids.

In one embodiment, each of the entrance grid and the exit grid are comprised of a metal mesh.

In one embodiment, an angle formed by the inner diameters of the electrodes before the entrance grid in the xz-plane or the yz-plane is equal to or greater than 90 degrees.

In one embodiment, an angle formed by varying the inner diameter of the electrodes after the entrance grid in the xz-plane or the yz-plane is greater than 90 degrees.

In one embodiment, an angle formed by varying the inner diameter of the electrodes before the exit grid in the xz-plane or the yz-plane is greater than 90 degrees.

In one embodiment, an angle formed by varying the inner diameter of the electrodes after the exit grid in the xz-plane or the yz-plane is equal to or greater than 90 degrees.

DETAILED DESCRIPTION OF THE PREFERRED EMBODIMENTS

The present invention relates to methods, devices, and apparatuses for selectively trapping and releasing ions. In certain embodiments, a voltage is applied to a series or set of concentric ring electrodes—without the use of meshes—to selectively trap and release ions traveling through the rings. The voltage applied to the electrodes to repel the ions may be a RF field or a DC field. These gridless gate devices can release ions from a trap and achieve high sensitivity by reducing losses into the grids. The present invention also works efficiently at high pressures (>50 mtorr).

Figure 1A:
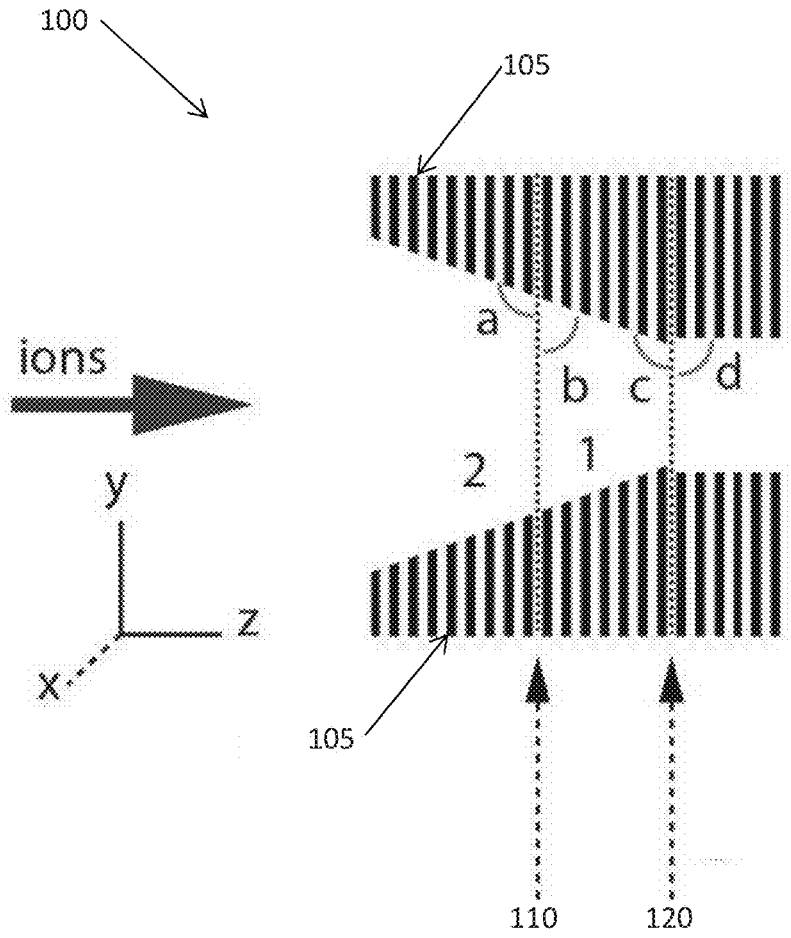
FIG. 1A is a schematic of an ion trap device with an entrance and exit grid, in accordance with one embodiment of the present invention.

FIG. 1A is a schematic of an ion trap device 100, in accordance with one embodiment of the present invention. The device 100 includes a series of electrodes 105, an entrance grid 110, and an exit grid 120. Ions are transmitted through an opening of the electrodes 105 toward the middle of the device 100. The electrodes 105 may be ring electrodes, and the ring electrodes may be assembled in stacks.

Confinement of the ions inside the device 100 may be achieved by applying 180 degrees out-of-phase radio frequency (RF) waveform to adjacent electrodes of the series of electrodes 105. A DC voltage may be superimposed with the RF waveform to create a DC gradient to help drive ions through the device 100.

The entrance grid 110 and the exit grid 120 provide confinement or trapping of the ions in area 2 or area 1 of the device 100. The inner diameters of the ring electrodes 105 can be increasing, decreasing, constant, or some combination.

Assuming the device 100 axis is z, which is the axis on which ions travel, the angle (a) formed by the inner diameters of the electrodes 105 before the entrance grid 110 in the xz-plane or the yz-plane is greater than or equal to about 90 degrees. The angle (b) formed by varying the inner diameter of the electrodes 105 after the entrance grid 110 in xz-plane or the yz-plane is greater than about 90 degrees. The angle (c) formed by varying the inner diameter of the electrodes 105 before the exit grid 120 in the xz-plane or the yz-plane is greater than about 90 degrees, and the angle (d) formed by varying the inner diameter of the electrodes 105 after the exit grid 120 in the xz-plane or the yz-plane is greater than or equal to about 90 degrees. Voltages are applied to the electrodes 105 to trap the ions in area 2 or in area 1.

Figure 1B:
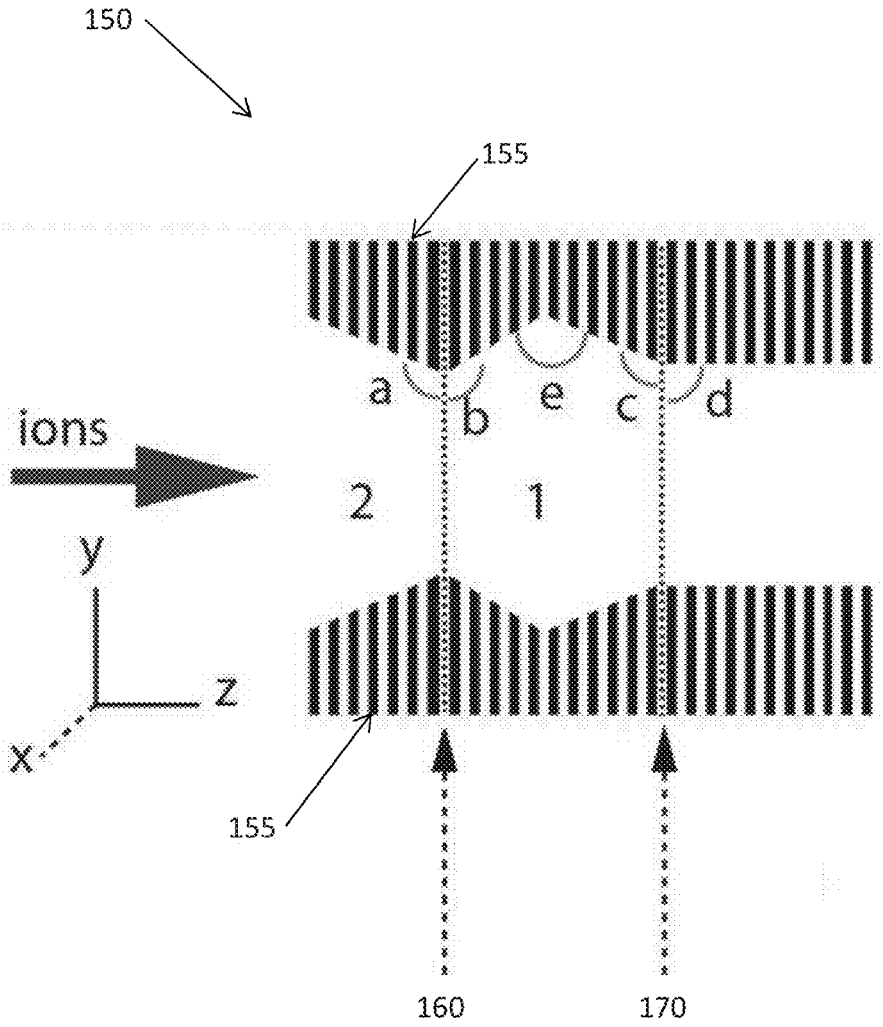
FIG. 1B is a schematic of an ion trap device with an entrance and exit grid, in accordance with one embodiment of the present invention.

FIG. 1B is another embodiment of an ion trap device 150 with electrodes 155, an entrance grid 160 and an exit grid 170. Ions are transmitted through an opening of the electrodes 155 towards the middle of the device 150.

An angle (a) formed at the junction between the electrodes 155 positioned in the region immediately before or adjacent to the entrance grid 160 in the xz-plane or the yz-plane may be greater than or equal to about 90 degrees. An angle (b) formed by varying the diameters of the ring electrodes 155 positioned immediately after the entrance grid 160 in the xz-plane or the yz-plane may be greater than about 90 degrees. An angle (e) formed at the juncture between a section of electrodes 155 with increasing inner diameters and a section of electrodes 155 with decreasing inner diameters in the xz-plane or the yz-plane may be greater than about 90 degrees. An angle (c) formed by varying inner diameters of the electrodes 155 positioned before the exit grid 170 in the xz-plane or the yz-plane is greater than about 90 degrees. An angle (d) formed by varying inner diameters of the electrodes 155 positioned after exit grid 170 in the xz-plane or the yz-plane may be greater than or equal to about 90 degrees. Voltages are applied to the electrodes 155 to trap the ions in area 2 or area 1.

Figure 4A:
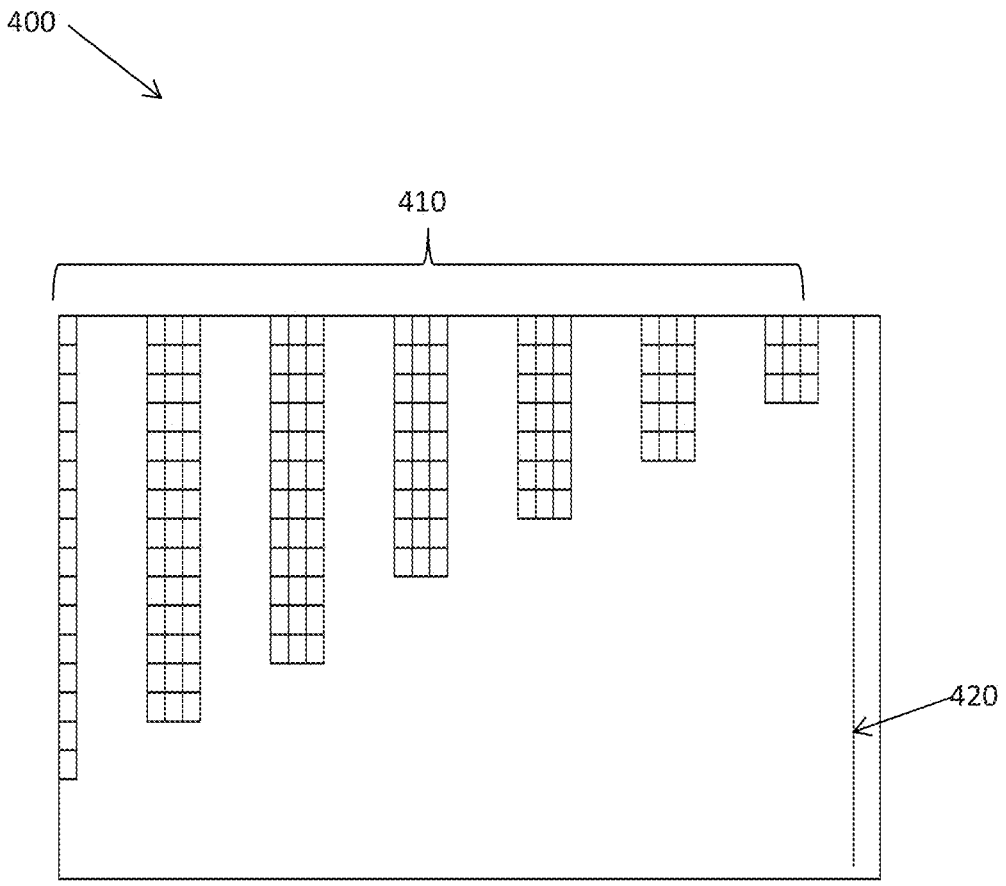
FIG. 4A is a schematic of an ion trap device with stacked-ring electrodes and DC grid, in accordance with one embodiment of the present invention.

FIG. 4A is a schematic of an ion trap device 400 with stacked-ring electrodes 410 and DC grid 420 that repels ions, in accordance with one embodiment of the present invention.

Figure 4B:
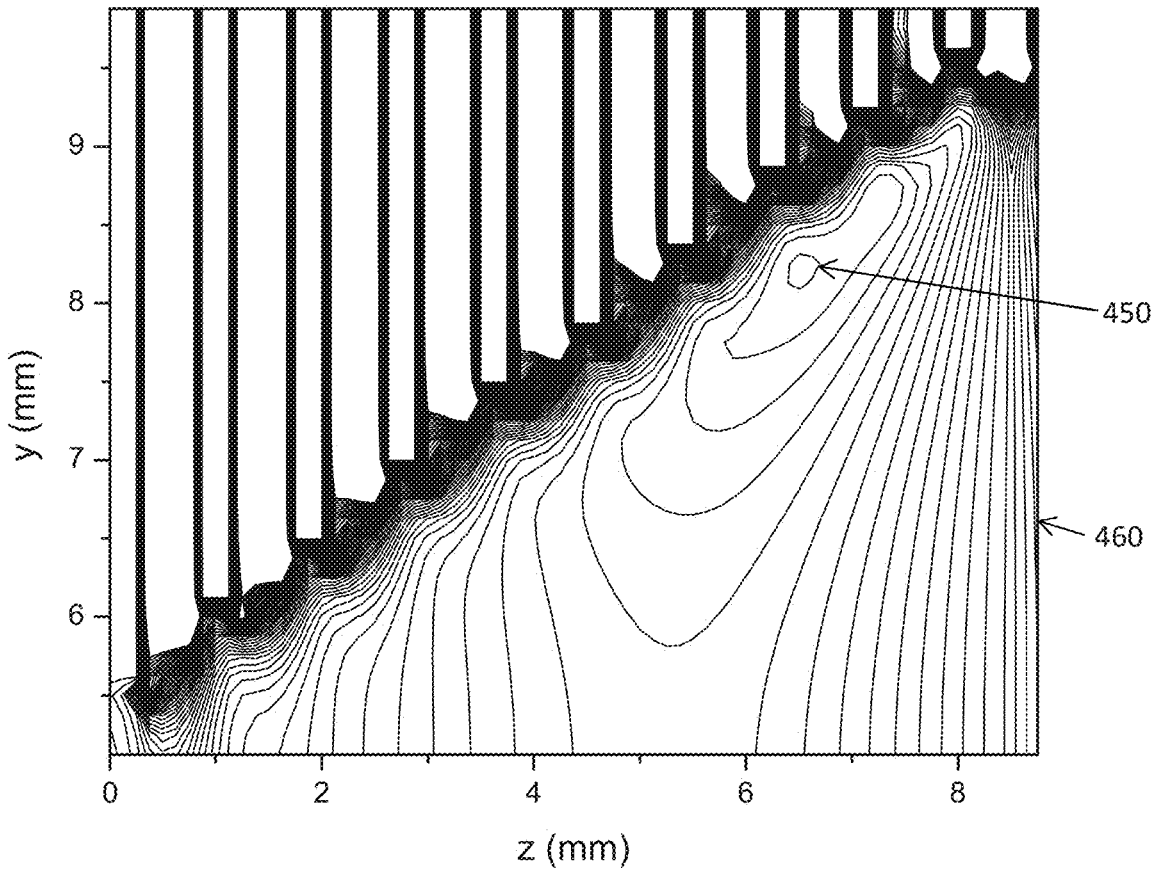
FIG. 4B shows the effective potential contour lines of the ion trap device of FIG. 4A.

FIG. 4B shows the effective potential contour lines 460 of the ion trap device of FIG. 4A. The lowest point of the potential and ions are "sucked" into a valley 450 close to electrodes leading to their loss. To minimize ion losses the angle at the exit grid or exit gate (FIGS. 1A and 1B) needs to be greater than or equal to about 90 degrees.

In the proposed designs, the ions may be sampled from a continuous ion source such as an electrospray ionization (ESI) source. The entrance gate or grid controls the number of ions entering a trapping region and then the potential on the entrance grid is adjusted to prevent further admittance of ions. Ions are trapped by adjusting the potential on the exit gate or grid such that ions cannot pass. After a predetermined trap time ions are released from the trap. Ions that are not allowed to enter the trap are lost to the electrode preceding the entrance grid utilizing a steep DC gradient superimposed on the RF waveforms applied to the electrodes that precede the entrance grid. In this case, the trap is always sampling ions from a continuous source.

The device can store and release ions quickly into a mass analyzer such as a mass spectrometer. Ions may be stored in the device by confining ions radially as well as axially. The term "radially" as used herein is not intended to be limited to a circular geometry only. Ions may be confined radially in concert with a segmented multipole in which an "out-of-phase" RF field may be applied to adjacent rods, and a different DC voltage may be applied to different segments of the same rod. Adjacent segments, which may be aligned radially, may include an out-of-phase RF-field, while adjacent segments aligned axially may have the same RF-field. Segmenting the multipole can allow precise control of the velocity of the ions as the ions exit the trap, particularly at high pressures and in cases where one or more tightly focused packets of ions are required. Adjacent segments of the device may be separated by air or by various dielectric materials. The radius on which the multipole is aligned (e.g., the inscribed radius) can be constant or can change through the trap.

To keep ions from exiting the trap during the storage period or accumulation period ions may also be confined axially (i.e. in the z direction). Here, axial confinement may be provided through two approaches. In one approach, ions may be axially confined in concert with an RF confinement. RF confinement may be accomplished by applying an out-of-phase RF field to an adjacent set of wires that creates an RF-wall. The set of wires can be biased with a DC potential in addition to the applied RF field. Ions may then be released from the trap by removing the RF field from the set of wires to allow ions to pass through the wires. In a second approach, ions may be confined axially by creating a potential well by applying appropriate DC potentials to a set of ring electrodes which may be separated by constant distance or variable distances. The combination of the number of electrodes, different spacings between the electrodes, and the voltages that are applied to the electrodes creates a potential well that confines ions axially.

Ions that are not admitted to area or trap 1 by the entrance grid are trapped behind the entrance grid by adjusting the DC gradient applied to the electrodes preceding the entrance grid. The DC gradient is superimposed on the RF waveforms. Trapping ions behind the entrance grid creates a second trap volume (area or trap 2). When the ions are released from trap 1, the entrance grid allows more ions to enter trap 1. For example, a highly dense ion packet from trap 2 enters trap 1. This is beneficial to improve the trapping of low abundance species which may not have enough time to be accumulated in trap 1.

In the present invention, ion gates that allow ions to flow into and out of the ion trap can be achieved by repelling ions via either: 1) a DC potential profile created by applying a DC voltage to one or more of the electrodes or 2) an "RF wall" created by applying a 180 degrees (or substantially 180) degrees out-of-phase RF field to adjacent wires. These gridless approaches simplify the design of the gate by eliminating the metallic mesh and using electrodes with openings to allow ions to pass through.

Figure 2A:
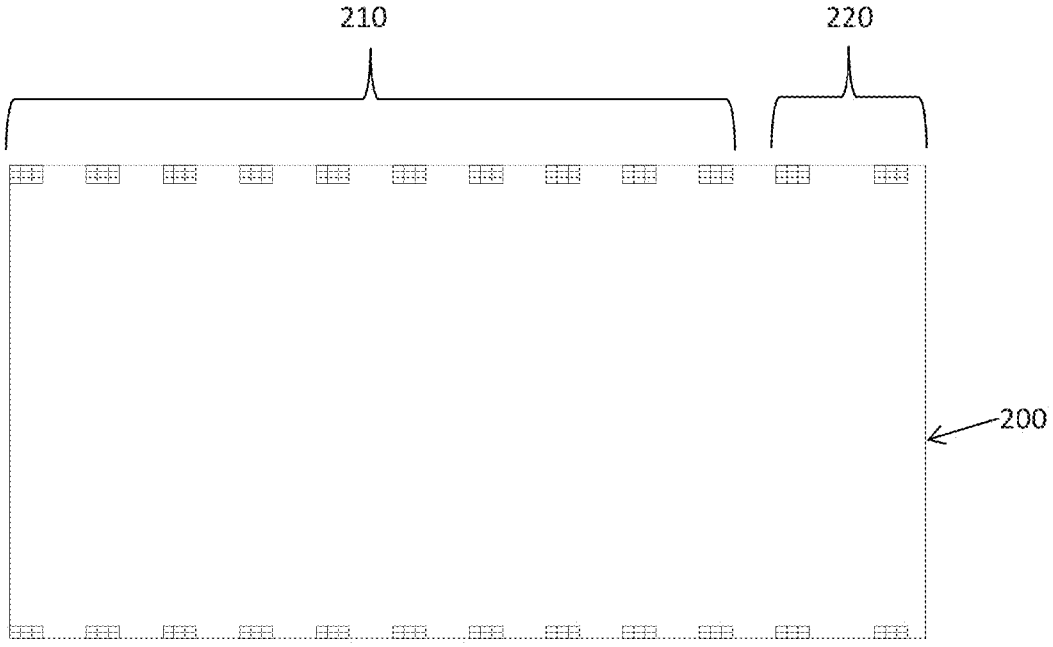
FIG. 2A is a schematic of a gridless ion trap device, in accordance with one embodiment of the present invention.

The DC potential profile can be shaped by varying the number of the electrodes, distance between the ring electrodes, and the voltage applied to each one of the electrodes. One embodiment of this gridless ion trap device 200 is shown in FIG. 2A. The device 200 includes a set of stacked electrodes 210 for trapping ions wherein an out-of-phase RF field is applied to adjacent electrodes. A DC gradient is superimposed over the RF field. The RF field on the electrodes helps confine the trapped ions radially. The device 200 also includes one or more DC-only electrodes 220. The DC-only electrodes 220 have no RF field but instead the voltages applied to these electrodes are chosen to be high enough to repel ions. The voltages applied to the DC-only electrodes 220 are separated from a resistors chain that supplies the DC gradient to the rest of the device 200.

Figure 2B:
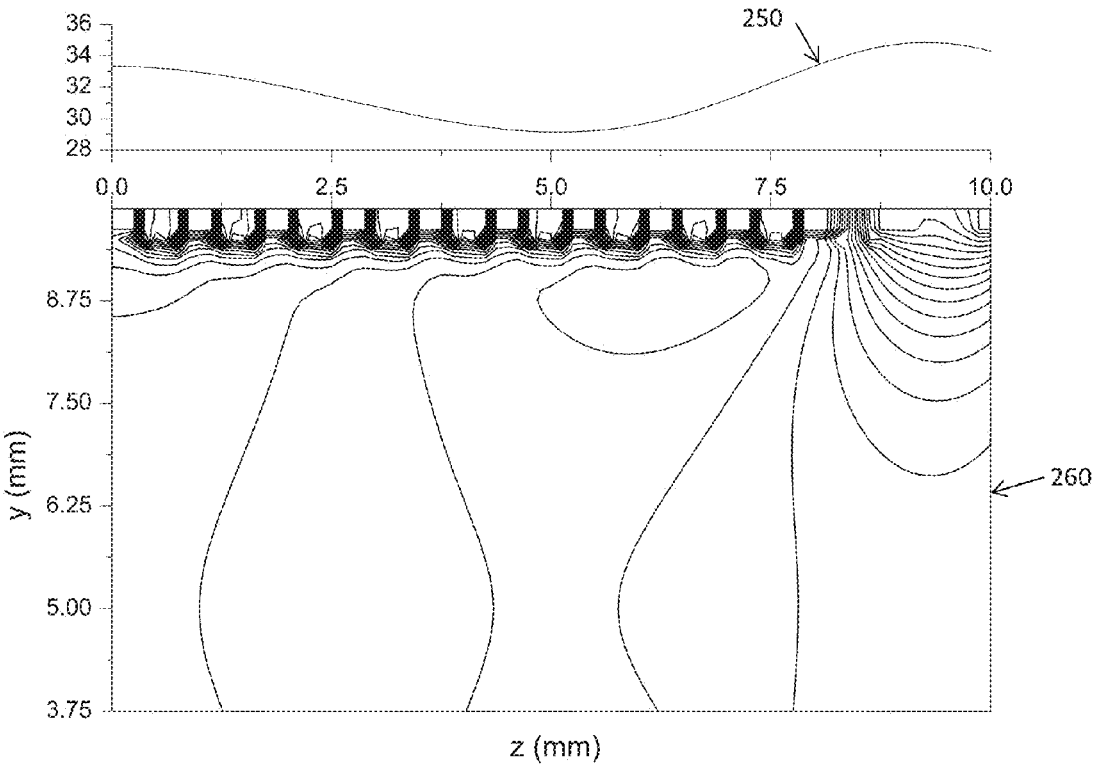
FIG. 2B shows the potential profile along the trap axis of the ion trap device of FIG. 2A and the effective potential contour lines.

FIG. 2B shows the potential profile 250 along the trap axis of the ion trap device of FIG. 2A and the effective potential contour lines 260. The calculated effective potential due to the RF field as well as the superimposed DC potential is shown for the middle plane across the ion trap device 200. The profile of the potential along the trap axis (z axis) shows this repelling potential.

Figure 3A:
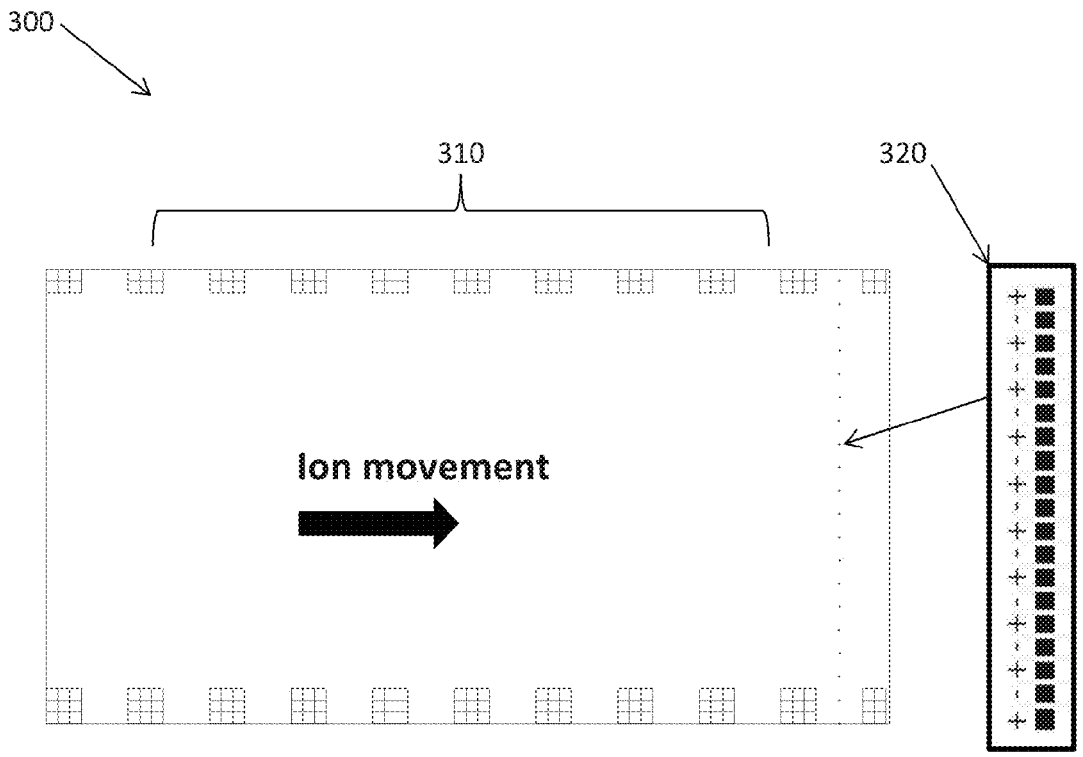
FIG. 3A is a schematic of an ion trap device with RF wires substantially perpendicular to the ion path, in accordance with one embodiment of the present invention.

Ion gating can also be achieved utilizing an RF field. FIG. 3A is a schematic of an ion trap device 300. The device 300 includes a series of electrodes 310 that define the ion flow path. A first RF field is applied to the series of electrodes such that each electrode is phase shifted approximately 180 degrees from an adjacent electrode. A DC voltage is superimposed with the first RF field to create a DC gradient to drive ions in the direction of the gradient.

The device also includes one or more wires 320 substantially perpendicular to the ion path to repel the ions and confine them axially. Each point along the wires 320 represents a cross-section of one of the wires 320. RF on each wire is phase shifted approximately 180 degrees from an adjacent wire by application of a second RF field to the wires 320.

Figure 3B:
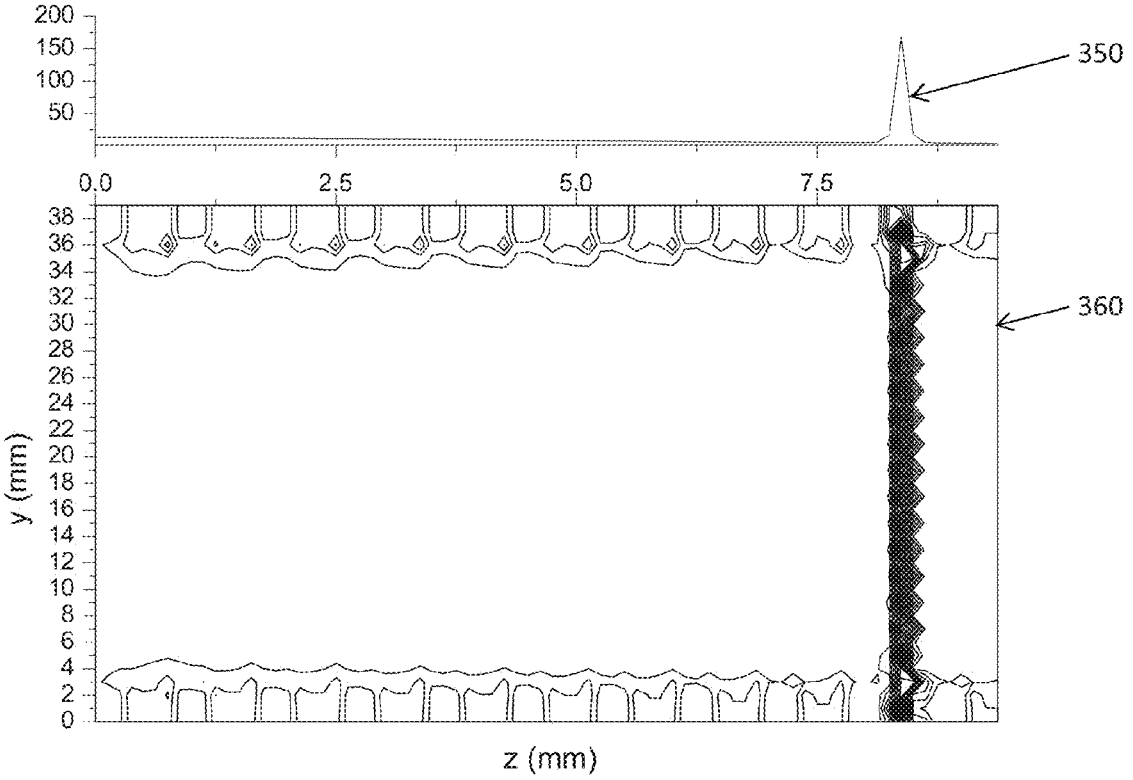
FIG. 3B shows the potential profile along the trap axis of the ion trap device of FIG. 3A and the effective potential contour lines.

FIG. 3B shows the potential profile 350 along the trap axis of the ion trap device of FIG. 3A and the effective potential contour lines 360. As shown in FIG. 3B, the distribution of the voltage is constant until application of the RF field to the wires. At that point, the voltage is not in phase with the trap rings.

Figure 3C:
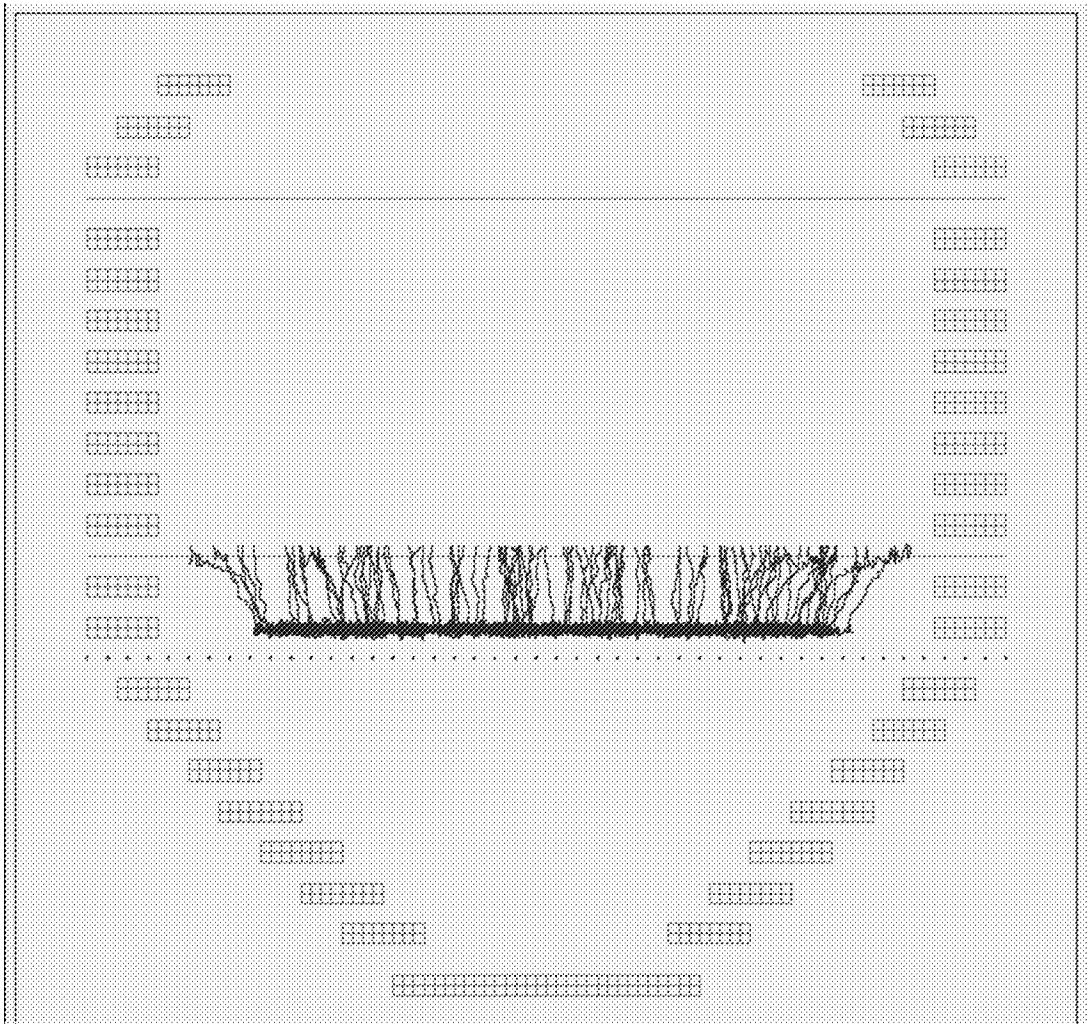
FIG. 3C is a SIMION simulation that shows that ions are trapped behind the RF wires of the ion trap device.

FIG. 3C is a SIMION simulation that shows that ions are trapped behind the RF wires of the ion trap device.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

We claim:

1. An ion trap device comprising:

a. a series of electrodes that define an ion flow path;

b. a first radio frequency (RF) field applied to the series of electrodes such that a first RF waveform on each electrode is phase shifted approximately 180 degrees from the first RF waveform on an adjacent electrode;

c. a DC voltage superimposed with the RF field to create a DC gradient to drive ions in the direction of the gradient; and d. two or more wires substantially perpendicular to the ion path, and substantially parallel to one another, to repel the ions and confine them axially, wherein a second RF waveform applied to each wire is phase shifted approximately 180 degrees from the second RF waveform applied to an adjacent wire by application of a second RF field to the wires, wherein the ions are selectively released from the device by reducing the RF field applied to the wires, and wherein the device is gridless.

2. The ion trap device of claim 1 wherein the series of electrodes are a series of stacked ring electrodes that define the ion flow path.

3. The ion trap device of claim 2 wherein each of the electrodes in the series has an inner geometry perimeter that is equal to, greater than, or smaller than, an adjacent electrode in the series.

4. The ion trap device of claim 1 wherein the device operates at a pressure of about 50 mtorr or higher.

5. The ion trap device of claim 1 wherein the DC gradient is between about 0 V/cm and about 100 V/cm.

6. An ion trap device comprising:

a. a first set of electrodes having an approximately 180 degrees out-of-phase RF field applied to adjacent electrodes of the first set, wherein a DC gradient is superimposed with the RF field to drive ions in the direction of the gradient; and b. A second set of electrodes, positioned adjacent to the first set of electrodes, wherein only a DC voltage is applied to the second set of electrodes to repel the ions, the ions are selectively released from the device in non-mass selective manner by reducing the DC voltage applied to the second set of electrodes, and wherein the device is gridless.

7. The ion trap device of claim 6 wherein the electrodes of the first set are stacked-ring electrodes, and wherein the electrodes of the second set are DC-only stacked-ring electrodes.

8. The ion trap device of claim 7 wherein the voltage applied to the second set of electrodes is separated from a resistors chain that supplies the DC gradient to the first set of electrodes.

9. The ion trap device of claim 6 wherein the device has a pressure of about 50 mtorr or higher.

10. The ion trap device of claim 6 wherein the DC gradient is between about 0 V/cm and about 100 V/cm.

11. An ion trap device comprising:

a. a series of stacked-ring electrodes that define an ion flow path;

b. an entrance grid and an exit grid, wherein the ions travel on the z axis of the device and wherein an angle formed by varying the inner diameters of two or more of the electrodes after the exit grid in the xz-plane or the yz-plane is greater than 90 degrees to minimize ion loss; and c. a DC voltage applied opposite the direction of the ion flow path to the grids, wherein the electrodes have an approximately 180 degrees out-of-phase RF field applied to adjacent electrodes and a DC gradient is superimposed with the RF field to drive ions in the direction of the gradient.

12. The ion trap device of claim 11 wherein each of the entrance grid and the exit grid are comprised of a metal mesh.

13. The ion trap device of claim 11 wherein an angle formed by the inner diameters of the electrodes before the entrance grid in the xz-plane or the yz-plane is equal to or greater than 90 degrees.

14. The ion trap device of claim 11 wherein an angle formed by varying the inner diameter of the electrodes after the entrance grid in the xz-plane or the yz-plane is greater than 90 degrees.

15. The ion trap device of claim 11 wherein an angle formed by varying the inner diameter of the electrodes before the exit grid in the xz-plane or the yz-plane is greater than 90 degrees.

* * * * *